US012459019B2

(12) United States Patent
Dressler et al.

(10) Patent No.: US 12,459,019 B2
(45) Date of Patent: Nov. 4, 2025

(54) ROLLING TAKING FREQUENCY BEHAVIOR INTO ACCOUNT

(71) Applicant: Primetals Technologies Germany GmbH, Erlangen (DE)

(72) Inventors: Matthias Dressler, Erlangen (DE); Daniel Kotzian, Forchheim (DE); Martin Schönherr, Forchheim (DE); Srdan Sekulic, Erlangen (DE)

(73) Assignee: Primetals Technologies Germany GmbH (DE)

( * ) Notice: Subject to any disclaimer, the term of this patent is extended or adjusted under 35 U.S.C. 154(b) by 292 days.

(21) Appl. No.: 18/012,280

(22) PCT Filed: May 26, 2021

(86) PCT No.: PCT/EP2021/064020
§ 371 (c)(1),
(2) Date: Dec. 22, 2022

(87) PCT Pub. No.: WO2022/008133
PCT Pub. Date: Jan. 13, 2022

(65) Prior Publication Data

US 2023/0256489 A1 Aug. 17, 2023

(30) Foreign Application Priority Data

Jul. 7, 2020 (EP) ..... 20184420

(51) Int. Cl.
*B21B 37/46* (2006.01)
*B21B 37/16* (2006.01)
(Continued)

(52) U.S. Cl.
CPC ..... *B21B 37/165* (2013.01); *B21B 37/46* (2013.01); *B21B 37/54* (2013.01); *B21B 37/58* (2013.01);
(Continued)

(58) Field of Classification Search
CPC ..... B21B 37/16; B21B 37/165; B21B 37/46; B21B 37/54; B21B 37/58; B21B 38/04; B21B 2015/0064; B21B 2261/04
See application file for complete search history.

(56) References Cited

U.S. PATENT DOCUMENTS 4,656,854 A 4/1987 Stewart et al. ..... 72/8
5,142,891 A 9/1992 Kuwano
(Continued)

FOREIGN PATENT DOCUMENTS

DE 102016224665 A1 7/2017
DE 102019207497 A1 12/2019
(Continued)

OTHER PUBLICATIONS

JP 2018-005544A, Hattori Jan. 2018.*
(Continued)

*Primary Examiner* — Edward T Tolan
(74) *Attorney, Agent, or Firm* — OSTROLENK FABER LLP

(57) ABSTRACT

A roll stand of a rolling mill is supplied with a metal strip by an upstream supply device at an in-feed speed (v), with said metal strip being rolled in the roll stand. A measuring device between the supply device and the roll stand detects a respective thickness value (d) of the metal strip for consecutive sections of the metal strip and supplies said value to a control device of the rolling mill. The control device determines final thickness deviations based on the preliminary thickness deviations. The control device determines a respective control value (A2, A3) for the roll stand and/or the supply device for the sections of the metal strip based on the final thickness deviation of the respective section of the metal strip and the final thickness deviations of multiple preceding and/or subsequent sections of the metal strip.

8 Claims, 5 Drawing Sheets

(51) Int. Cl.
*B21B 37/54* (2006.01)
*B21B 37/58* (2006.01)
*B21B 15/00* (2006.01)

(52) U.S. Cl.
CPC ... *B21B 2015/0064* (2013.01); *B21B 2261/04* (2013.01); *B21B 2271/02* (2013.01); *B21B 2273/20* (2013.01); *B21B 2275/04* (2013.01); *B21B 2275/12* (2013.01)

(56) References Cited

U.S. PATENT DOCUMENTS

| | | | | |
|---|---|---|---|---|
| 8,020,417 | B2 | 9/2011 | Karam et al. | 72/8.6 |
| 8,255,074 | B2 * | 8/2012 | Meissen | B21B 37/00 706/14 |
| 8,386,066 | B2 * | 2/2013 | Hofbauer | B21B 37/66 700/156 |
| 8,703,242 | B2 | 4/2014 | Kloeckner et al. | 427/329 |
| 2004/0221633 | A1 | 11/2004 | Abi-Karam | 72/10.2 |
| 2009/0031776 | A1 | 2/2009 | Karam et al. | 72/10.7 |
| 2018/0161839 | A1 | 6/2018 | McGahan | |

FOREIGN PATENT DOCUMENTS

| | | | |
|---|---|---|---|
| EP | 0435595 | A2 | 7/1991 |
| EP | 1488863 | A2 | 12/2004 |
| EP | 1627695 | A1 | 2/2006 |
| EP | 1488863 | A3 | 3/2006 |
| EP | 1861517 | B1 | 12/2008 |
| EP | 3332883 | A1 | 6/2018 |
| JP | S5868414 | A | 4/1983 |
| JP | H04-200915 | A | 7/1992 |
| JP | H05-293523 | A | 11/1993 |
| JP | H07-144207 | A | 6/1995 |
| JP | H07-191702 | A | 7/1995 |
| JP | H08-323408 | A | 12/1996 |
| JP | H10-211512 | A | 8/1998 |
| JP | H11-77125 | A | 3/1999 |
| JP | 2003-266110 | A | 9/2003 |
| JP | 2003-311308 | A | 11/2003 |
| JP | 2012-130937 | A | 7/2012 |
| JP | 2017-124428 | A | 7/2017 |
| JP | 2019-219865 | A | 12/2019 |
| WO | WO 2006/136670 | A1 | 12/2006 |
| WO | WO 2007/096204 | A1 | 8/2007 |
| WO | WO 2016151855 | A1 | 9/2016 |

OTHER PUBLICATIONS

JP 62-234608A, Endo et al. Oct. 1987.*
JP 10-58019A, Kodama et al. Mar. 1998.*
JP 2003-266110A, Tsutsumi Sep. 2003.*
2012-130937A, Shimizu et al. Jul. 2012.*
JP 05-200421A, Nakao et al. Aug. 1993.*
JP 63-132713A, Nakayama et al. Jun. 1988.*
Office Action dated May 13, 2024 issued in corresponding Japanese Patent Application No. 2023-501311.
EPO Communication of a Notice of Opposition dated Jul. 31, 2024 issued in corresponding European Patent Application No. 20184420.6.
Lorenz, A. et al; "Adaptive Eccentricity Compensation for Rolling Mills"; Siemens VAI Metals Technologies is now Primetals Technologies, Messeveröffentlichung Metec E 2nd Estad 2015; Jun. 19, 2015.
Kugi et al; "Active Compensation of Roll Eccentricity in Rolling Mills"; IEEE Transactions on Industry Applications; vol. 36, No. 2; 2000.
Garimella, Srinivas, S. et al; "Application of repetitive control and iterative learning control to cold rolling processes"; The Ohio State University 1994; 9517003.
International Search Report mailed Sep. 8, 2021 in corresponding PCT International Application No. PCT/EP2021/064020.

* cited by examiner

ROLLING TAKING FREQUENCY BEHAVIOR INTO ACCOUNT

CROSS-REFERENCE TO RELATED APPLICATIONS

The present application is a 35 U.S.C. §§ 371 national stage application of International Application No. PCT/EP2021/064020, filed May 26, 2021, which claims priority to European Patent Application No. EP20184420, filed Jul. 7, 2020, the contents of which are incorporated herein by reference.

TECHNICAL FIELD

The present invention is based on an operating method for a rolling mill,

- wherein a metal strip is fed to a rolling stand of the rolling mill at an entry speed by a feeding device arranged upstream of the rolling stand,
- wherein the metal strip is rolled in the rolling stand,
- wherein a thickness value for the thickness of the metal strip is detected in each case for successive portions of the metal strip by means of a measuring device arranged between the feeding device and the rolling stand,
- wherein the detected thickness values are fed to a control device of the rolling mill,
- wherein the control device determines a respective provisional thickness deviation on the basis of the deviation of the respective thickness value from a setpoint thickness for the respective portion of the metal strip,
- wherein the control device determines final thickness deviations on the basis of the provisional thickness deviations,
- wherein the control device determines a control value for the rolling stand and/or the feeding device in each case for the portions of the metal strip and outputs the respective control value to the rolling stand and/or the feeding device at the correct time.

The present invention is also based on a control program which comprises machine code that can be executed by a control device for a rolling mill, wherein the execution of the machine code by the control device brings about the effect that the control device operates the rolling mill according to such an operating method.

The present invention is also based on a control device for a rolling mill, wherein the control device is programmed with such a control program, so that the control device operates the rolling mill according to such an operating method.

The present invention is also based on a rolling mill for rolling a metal strip,

- wherein the rolling mill has at least one rolling stand, a feeding device arranged upstream of the rolling stand, a measuring device arranged between the feeding device and the rolling stand, and a control device,
- wherein the metal strip is fed to the rolling stand at an entry speed by the feeding device,
- wherein the metal strip is rolled in the rolling stand,
- wherein a thickness value for the thickness of the metal strip is detected in each case for successive portions of the metal strip by the measuring device,
- wherein the detected thickness values are fed to the control device,
- wherein the control device operates the rolling mill according to an operating method as such.

When producing metal strip, after the casting of a slab, the slab is first hot-rolled, so that a hot strip is created. The thickness of the hot strip usually lies in the range of a few millimeters, depending on the production process sometimes also somewhat above or below that, for example between 1.0 mm and 20 mm in the case of a normal hot rolling mill and between 0.6 mm and 6 mm in the case of a so-called ESP plant. In some cases, the hot strip is further processed without further thickness reduction. In other cases, after the hot rolling the strip thickness is reduced still further in a cold rolling mill. The aim of the cold rolling is the production of a cold-rolled metal strip of which the final thickness coincides with a target thickness as well as possible and with the smallest possible deviation.

The finished hot strip—that is to say after the hot rolling but before the rolling in the cold rolling mill—generally has thickness deviations. The thickness deviations often have both periodic components and stochastic components. Without compensation for these deviations, the metal strip also has such deviations after the cold rolling. Although the absolute extent of the deviations is less than in the case of the hot strip, the relative deviation persists. If therefore—for example—before the cold rolling the metal strip has a thickness of 3.0 mm and thickness deviations in the range of 30 μm and after the cold rolling the metal strip still has a thickness of 1.0 mm, without compensation for the thickness deviations the metal strip has after the cold rolling thickness deviations in the range of 10 μm.

PRIOR ART

Various procedures for compensating for such deviations are known in the prior art.

Thus, for example, it is known from EP 0 435 595 A2 to detect the thickness of the rolled metal strip on the exit side of a rolling stand and to perform thickness feedback control of the rolling stand. There is also compensation for fluctuations in tension, since they also influence the thickness of the rolled metal strip. To achieve relatively highly dynamic feedback control of the tension, between the feeding device and the rolling stand on the one hand and also between the rolling stand and a taking-up device arranged downstream of the rolling stand on the other hand there are rollers or similar elements by means of which the metal strip can be deflected before and/or after the rolling in the rolling stand. The procedure of EP 0 435 595 A2 is based on the idea that the feedback control by the feeding device itself and the taking-up device itself is very slow to react and the dynamics of the feedback control can be increased by the additional rollers. EP 0 435 595 A2 also includes a description of a procedure in which the thickness and the speed of the metal strip are detected on the entry side of the rolling stand and are used in the course of determining the adjustment of the rolling stand.

It is likewise known from EP 3 332 883 A1 to detect the thickness of the rolled metal strip on the exit side of a rolling stand and to perform thickness feedback control of the rolling stand. Periodic deviations are separated from stochastic deviations. Periodic deviations are considered to be caused by eccentricities of the rolls of the rolling stand. The correction of the adjustment of the rolling stand takes place correspondingly.

In the case of JP 58 068 414 A, the thickness of the still unrolled metal strip is detected on the entry side of the rolling stand and averaged over certain units of length. The average is used for controlling the adjustment of the rolling stand.

SUMMARY OF THE INVENTION

Deviations of the entry thickness can already be compensated for to a certain extent by means of the procedures from the prior art. However, the procedures from the prior art are still able to be improved.

The object of the present invention is to provide possibilities by means of which excellent compensation for entry-side thickness deviations of the metal strip can be achieved.

The object is achieved by an operating method for a rolling mill as claimed. Advantageous configurations of the operating method are the subject of dependent claims.

According to the invention, an operating method of the type mentioned at the beginning is configured such that the control device determines the respective control value on the basis of the final thickness deviation of the respective portion of the metal strip and also the final thickness deviations of a plurality of portions of the metal strip preceding and/or succeeding the respective portion of the metal strip, with allowance for a description of the inverse frequency response of the rolling stand and/or the feeding device and/or the measuring device.

It has been recognized by the inventors that the extent to which a determined thickness deviation is corrected depends not only on the thickness deviation itself, but also on the range of the thickness deviations. In particular, compensation for thickness deviations of a higher frequency is generally only provided to a lesser extent and with a greater phase offset than for thickness deviations of a lower frequency. To be able to compensate for thickness deviations of a higher frequency also to the full extent and without a phase offset, allowance must therefore be made for the frequency response of the controlled device—this is generally the adjustment of the rolling stand for the size of the rolling gap and the feeding device for the entry speed and/or the size of the entry-side tension. It may be the case that the measured-value acquisition also has a frequency response, for which allowance can also be made in this case. Allowance is made on the basis of a description of the inverse frequency response of the rolling stand and/or the feeding device and/or the measuring device.

There are various possibilities for the manner in which allowance is made. The currently preferred way is

- that the description of the inverse frequency response of the rolling stand and/or the feeding device and/or the measuring device is specified for the control device by an inverse model,
- that the final thickness deviation of a portion of the metal strip is in each case fed to the inverse model, and
- that the control device using the respective final thickness deviation by means of the inverse model on the one hand correctively adjusts an internal state of the inverse model and on the other hand determines the respective control value.

This procedure is associated with the lowest computational complexity.

Alternatively, it is possible that the description of the inverse frequency response of the rolling stand and/or the feeding device and/or the measuring device is specified for the control device as a frequency-response characteristic, and that the control device determines the respective control value by a transformation of the profile of the final thickness deviations into the frequency domain, a subsequent multiplication of the transformed profile of the final thickness deviation by the frequency-response characteristic and a subsequent inverse transformation into the time domain. This procedure leads to particularly high-quality results.

It is generally known that a multiplication in the frequency domain corresponds to a convolution in the time domain. It is therefore alternatively possible and totally equivalent that that the description of the inverse frequency response of the rolling stand and/or the feeding device and/or the measuring device is specified for the control device as a convolutional kernel, and that the control device determines the respective control value by a convolution of the profile of the final thickness deviations with the convolution kernel.

The detection of the frequency-response characteristic, and on this basis the determination or parameterization of the inverse model or the determination of the gains for the individual frequency ranges or the determination of the convolution kernel may take place in an automated manner. In particular, while the rolling mill is in operation, defined minor disturbances may be imparted to the setpoint rolling-gap value of the rolling stand. These disturbances are reflected on the exit side of the rolling stand in corresponding fluctuations of the exit-side thickness of the metal strip. If a measuring device by means of which this exit-side thickness is detected is arranged downstream of the rolling stand, the frequency-response characteristic can be determined in an automated manner by a combined evaluation of the imparted disturbances on the one hand and the fluctuations of the exit-side thickness on the other hand. This is known in principle to those skilled in the art.

Preferably, for determining the respective control value the control device uses both final thickness deviations of portions of the metal strip preceding the respective portion of the metal strip and final thickness deviations of portions of the metal strip succeeding the respective portion of the metal strip. The determination of the respective control value is particularly reliable as a result. This holds true especially if the number of portions of the metal strip which precede the respective portion of the metal strip and whose final thickness deviations are used by the control device for determining the respective control value is substantially equal to the number of portions of the metal strip which succeed the respective portion of the metal strip and whose final thickness deviations are used by the control device for determining the respective control value.

In the simplest case, the control device adopts the provisional thickness deviations 1:1 as final thickness deviations. Preferably, however, the control device determines the final thickness deviations from the provisional thickness deviations by means of a zero-phase filtering. This procedure results in stabler and more robust operation of the rolling stand and/or the feeding device. This holds true especially if a low-pass filtering of the provisional thickness deviations is carried out by means of the zero-phase filtering.

The object is also achieved by a control program as claimed. According to the invention, the execution of the control program brings about the effect that the control device operates the rolling mill according to an operating method according to the invention.

The object is also achieved by a control device as claimed. According to the invention, the control device is programmed with a control program according to the invention, so that the control device operates the rolling mill according to an operating method according to the invention.

The object is also achieved by a rolling mill as claimed. According to the invention, the control device operates the rolling mill according to an operating method according to the invention.

BRIEF DESCRIPTION OF THE DRAWINGS

The above-described properties, features and advantages of this invention and the way in which they are achieved will become clearer and more clearly understood in association with the following description of the exemplary embodiments which are explained in greater detail in conjunction with the drawings, in which, in a schematic illustration.

DESCRIPTION OF THE EMBODIMENTS

Figure 1:
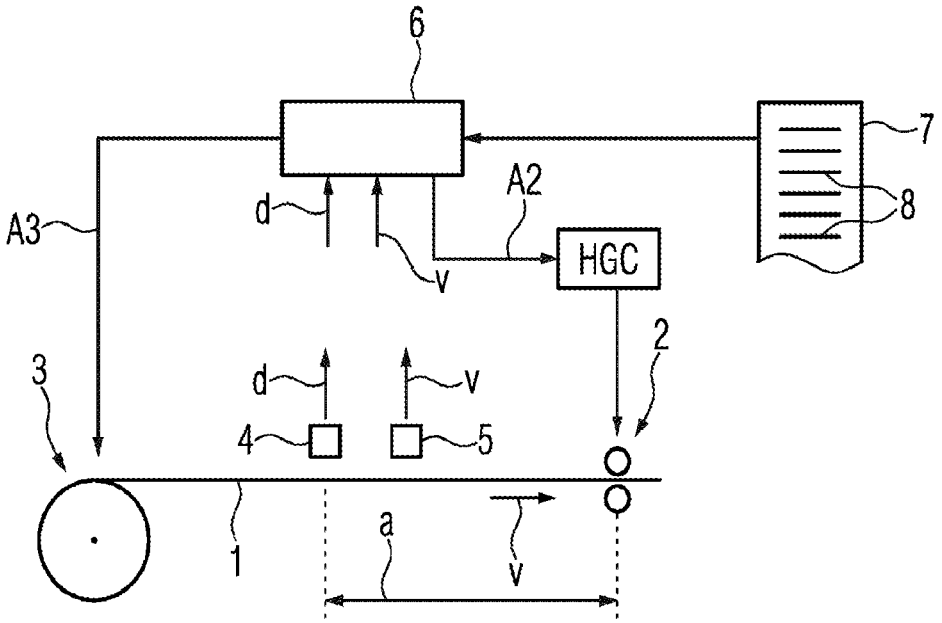
FIG. 1 shows a rolling mill.

According to FIG. 1, a rolling mill for rolling a metal strip 1 has a rolling stand 2. The metal strip 1 is rolled in the rolling stand 2. The rolling stand 2 may be in particular a cold rolling stand, in which consequently a cold rolling of the metal strip 1 takes place. Only the working rollers of the rolling stand 2 are illustrated in FIG. 1. Generally, the rolling stand 2 additionally comprises at least two back-up rollers (four-high stand), in some cases even more rollers. For example, the rolling stand 2 may be formed as a six-high stand (two working rollers, two intermediate rollers, two back-up roller) or as a 12-roller rolling stand or as a 20-roller rolling stand. The metal strip 1 may consist of steel, of aluminum or of some other metal, for example of copper or of brass.

The rolling mill also has a feeding device 3. The feeding device 3 is arranged upstream of the rolling stand 2. The metal strip 1 is fed to the rolling stand 2 at an entry speed v by the feeding device 3. According to FIG. 1, the feeding device 3 is formed as a coiler. It could however also be formed differently, for example as a driver or as a further rolling stand different from the rolling stand 2. The feeding device 3 may also be formed as a so-called S-roller, that is to say a number of rollers by way of which the metal strip 1 ends up being guided in an S-shape manner.

Strictly speaking, the speed at which the metal strip 1 enters the rolling stand 2 and the speed at which the metal strip 1 is dispensed (for example uncoiled) from the feeding device 3 must be differentiated from one another. The speed at which the metal strip 1 enters the rolling stand 2 is determined by the circumferential speed of the working rollers of the rolling stand 2 and the lag in the rolling stand 2. In the case of a coiler, for example the speed at which the metal strip 1 is dispensed by the feeding device 3 is determined by the rotational speed at which the coiler rotates the coil and the present diameter of the coil, which diameter changes over time. Slight differences between these two speeds may exist momentarily. If such momentary differences exist, the tension that prevails in the metal strip 1 between the feeding device 3 and the rolling stand 2 changes. However, reference is made only to the entry speed v hereinafter. Unless explicitly mentioned, the speed at which the metal strip 1 is dispensed by the feeding device 3 is meant below, in case of doubt.

A measuring device 4 is arranged between the feeding device 3 and the rolling stand 2. A thickness value d for the thickness of the metal strip 1 is repeatedly detected iteratively by means of the measuring device 4. Furthermore, a further measuring device 5 may additionally be present, by means of which a measured value for the entry speed v is repeatedly detected.

The respectively detected thickness value d and optionally also the respectively detected value for the entry speed v are fed to a control device 6, which is likewise a component part of the rolling mill. The control device 6 repeatedly determines a control value A2, A3 for the rolling stand 2 and/or the feeding device 3. The control device 6 generally determines both control values A2, A3.

The control value A2 for the rolling stand 2 very generally affects at least the adjustment of the rolling stand 2, i.e. the setting of the rolling gap. By way of example, the respective control value A2 can be output to a so-called HGC (=hydraulic gap control). Alternatively, the control value A2 may affect the main drive of the rolling stand 2, i.e. change the rolling torque or the rolling speed. The control value A2 often affects both the adjustment of the rolling stand 2 and the main drive thereof. In this case, the control value A2 for the rolling stand 2 can be regarded as a vector quantity having in each case a component for the adjustment of the rolling stand 2 and for the main drive of the rolling stand 2.

The control value A3 is fed to a rotational speed or torque feedback control for the feeding device 3 and affects the entry speed v and/or the tension that prevails in the metal strip 1 on the entry side of the rolling stand 2. If necessary, further devices arranged upstream of the feeding device 3 also have to be concomitantly controlled in the context of the control of the feeding device 3. Although making allowance for such further devices makes the calculation of the control value A3 more complex, it does not change anything in regard to the principle of the present invention.

The control device 6 is programmed with a control program 7. The control program 7 comprises machine code 8 that can be executed by the control device 6. The programming of the control device 6 with the control program 7 or the execution of the machine code 8 by the control device 6 brings about the effect that the control device 6 operates the rolling mill according to an operating method explained in greater detail below. In this case, reference is made firstly to FIG. 2 and then to FIGS. 3 and 4.

Figure 2:
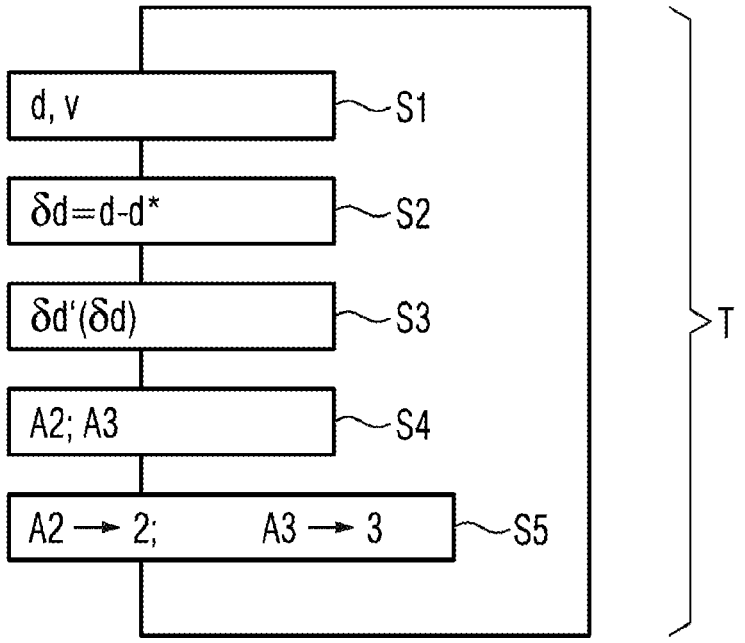
FIG. 2 shows a flow diagram.

According to FIG. 2, in a step S1, the control device 6 receives the respectively detected thickness value d and optionally also the respectively detected value for the entry speed v. In a step S2, the control device 6 determines the deviation δd of the detected thickness value d from a setpoint thickness d*, referred to hereinafter for short as thickness deviation δd.

The thickness deviation δd determined in step S2 is only a provisional thickness deviation δd. In a step S3, the control device 6 determines a respective final thickness deviation δd' on the basis of the provisional thickness deviation δd. In the simplest case, step S3 is of trivial nature. In this case, the control device 6 adopts the provisional thickness deviations δd 1:1 as final thickness deviations δd'.

A genuine determination preferably takes place, however, such that the final thickness deviations δd' are determined from the provisional thickness deviations δd by means of a non-trivial determination specification. By way of example, for determining the final thickness deviations δd' the control device 6 may carry out a zero-phase filtering in step S3. By means of a zero-phase filtering, a filtered profile of values (here the temporal profile of the final thickness deviations δd') is determined from an original profile of values (here the temporal profile of the provisional thickness deviations δd), with no systematic phase offset occurring between the original profile and filtered profile. In general and also in the context of the present invention, the zero-phase filtering is a low-pass filtering, with the result that high-frequency fluctuations are thus filtered out. The low-pass filtering, in particular, significantly improves the stability of the inverse modeling of the rolling stand 2, the feeding device 3 and/or the measuring device 4.

For a zero-phase filtering, it is also necessary to know the provisional thickness deviations δd of portions 9 succeeding that portion 9 whose final thickness deviation δd' is intended to be determined. In the case of a zero-phase filtering, therefore, step S3 is carried out for another portion 9, the provisional thickness deviation δd of which has already been detected.

Zero-phase filtering processes are generally known to those skilled in the art. The so-called IIR (=infinite impulse response) may be mentioned just by way of example. Another possibility for implementing a zero-phase filtering is a convolution of the provisional thickness deviations δd with a symmetric impulse response of an FIR filter (FIR=finite impulse response).

In a step S4, the control device 6 determines the control values A2, A3 using the final thickness deviations δd'. In a step S5, the control device 6 outputs the control values A2, A3 to the rolling stand 2 and/or the feeding device 3. The control device 6 then returns to step S1.

The procedure explained above in conjunction with FIG. 2 is thus carried out repeatedly in a cyclic manner. Usually, it is even carried out on a strictly clocked basis, that is to say with a fixed cycle time T of 8 ms, for example.

The procedure according to the invention is explained again in more detail below in conjunction with FIGS. 3 and 4.

Figure 3:
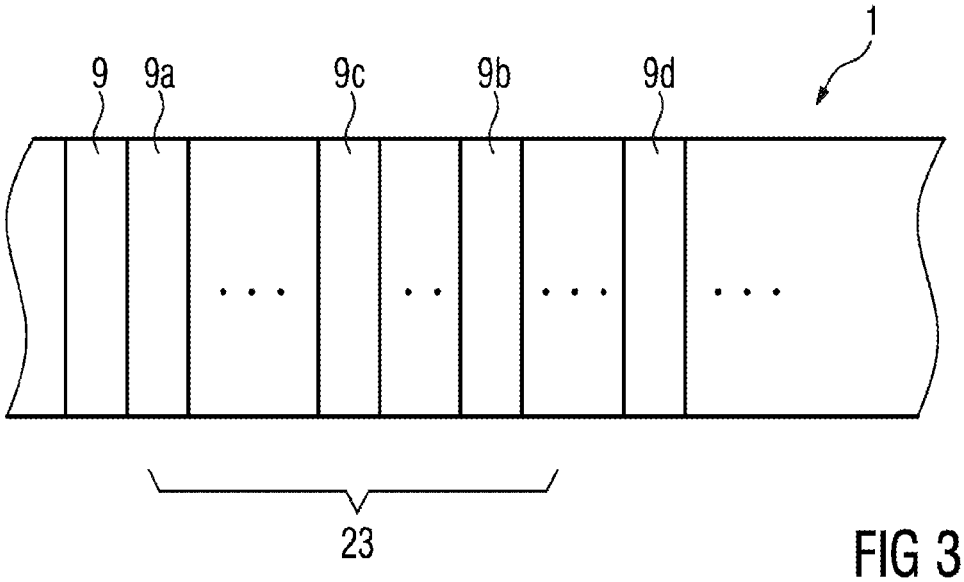
FIG. 3 shows a metal strip.
Figure 4:
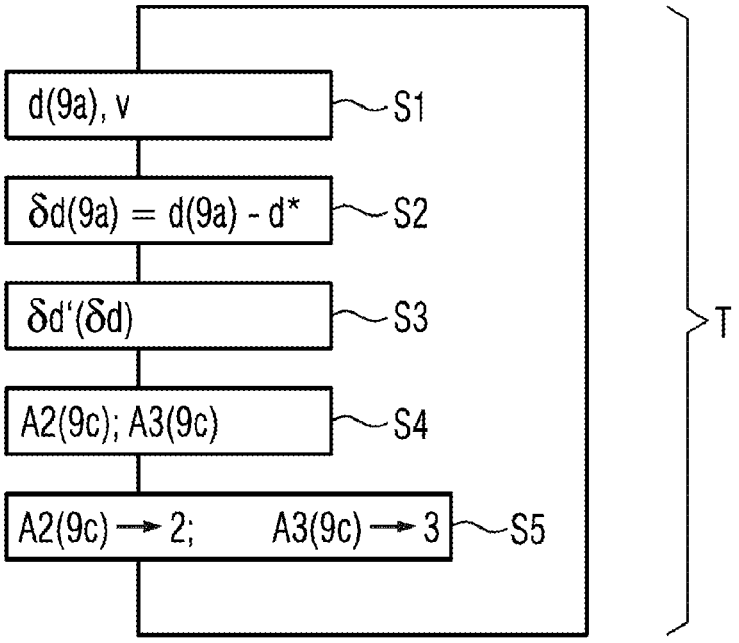
FIG. 4 shows a flow diagram.

FIG. 3 shows the metal strip 1 from above. The metal strip 1 is divided virtually into portions 9. In FIG. 3, some of the portions 9 are supplemented by a lower-case letter (for example a, b, etc.) in addition to the reference sign 9, in order to be able to reference them individually.

During each cycle, that is to say during each execution of step S1, for a specific portion 9—for example the portion 9*a*—the thickness value d thereof is detected and referred to the control device 6. The detected thickness value d, the associated provisional thickness deviation δd and the associated final thickness deviation δd' are thus related to this portion 9*a*.

During the same cycle, another portion 9—for example the portion 9*b*—is rolled in the rolling stand 2. The geometric distance between the portions 9*a* and 9*b* on the metal strip 1 corresponds to the geometric distance a between the measuring device 4 and the rolling stand 2.

A specific time period T' is required for conveying the portion 9*a* from the measuring device 4 to the rolling stand 2. This time period T' is usually referred to as transporting time. It is determined by the entry speed v of the metal strip 1 and the distance a between the measuring device 4 and the rolling stand 2. Given a constant entry speed v, the relationship T'=a/v holds true.

The time period T' is very generally considerably greater than the cycle time T. Therefore, between the portions 9*a* and 9*b* there are a number of further portions 9, for example portion 9*c*. For these portions 9, the respective thickness value d had already been detected before the rolling of the portion 9*b*. Furthermore, the metal strip 1 has portions 9 which had already been rolled in the rolling stand 2, for example the portion 9*d*.

Owing to the circumstance that the time period T' is required for conveying a respective portion 9 from the measuring device 4 to the rolling stand 2, it is possible in a specific cycle in step S1 indeed to detect the thickness value d for the portion 9*a* and to determine the provisional thickness deviation δd for this portion 9*a*, but in step S4 to determine the control values A2, A3 for the portion 9*c*, for example, and furthermore in step S5 to output the control values A2, A3 determined in step S4 to the rolling stand 2 and/or the feeding device 3. Optionally, control values A2, A3 which had already been determined beforehand for a portion 9 between the portion 9*c* and the portion 9*b* can also be output to the rolling stand 2 and/or the feeding device 3. In the last-mentioned case, it is merely necessary for the thickness values d detected in the respective cycle, the thickness deviations δd, δd' determined in the respective cycle and the control values A2, A3 determined in the respective cycle to be assigned to the respective portion 9 and for path tracking of the portions 9 to be carried out. The corresponding procedure is indicated in FIG. 4 by virtue of the fact that, in steps S1 to S5, the respective portion 9*a*, 9*b*, 9*c* for which the respective step S1 to S5 is carried out is designated as well. The reason why the control values A2, A3 output by the control device 6 are not related to the portion 9*b*, but rather to the portion 9*c* or a portion 9 between the portion 9*b* and the portion 9*c*, is that allowance has to be made for certain dead times of the rolling stand 2 and/or the feeding device 3.

The implementation of path tracking is generally known to those skilled in the art. As a result, it is thus possible to output the control values A2, A3 to the rolling stand 2 and/or the feeding device 3 at the correct time. In the context of the present invention, at the correct time means that control values A2, A3 output to the rolling stand 2 and/or the feeding device 3 affect the metal strip 1 at a point in time at which the respective portion 9 of the metal strip 1 is being rolled in the rolling stand 2. In this case, allowance can be made, as necessary, for the time period T' and if appropriate also reaction times (dead times) of the rolling stand' 2 and/or the feeding device 3. The reaction times are times required by the rolling stand 2 and/or the feeding device 3 to react to a control value A2, A3 newly fed thereto. Furthermore, allowance can also be made for dead times which occur in the communication between different devices or in the automation. The determination of the control values A2, A3 must of course be concluded before the outputting.

Owing to the circumstance that for the portions 9 between the portion 9*a* and the portion 9*c* the respective thickness value d has already been detected and accordingly the respective provisional thickness deviation δd is also already known and, furthermore, the final thickness deviations δd' are also known at least for the portions 9 adjoining the portion 9*c* in the direction of the portion 9*a*, it is possible, for example for the determination of the control values A2, A3 for the portion 9*c*, to make allowance not only for the final thickness deviation δd' of the portion 9*c*, but additionally also any of the other final thickness deviations δd', provided that they have actually already been determined. By way of example, in addition to the thickness deviation δd' of the portion 9*c*, the control device 6 can make allowance for the final thickness deviations δd' of a plurality of adjacent portions 9 toward the portion 9*a*. Alternatively or additionally, in addition to the thickness deviation δd' of the portion 9*c*, the control device 6 can make allowance for the final thickness deviations δd' of a plurality of adjacent portions 9 toward the portion 9*b* and optionally also beyond the portion 9*b*.

In the context of the determination of the respective control value A2, A3, the control device 6 furthermore makes allowance for a description of the inverse frequency response of the rolling stand 2 and/or the feeding device 3 and/or the measuring device 4. A description that directly characterizes the corresponding frequency response as such is thus specified for the control device 6. To put it another way: the frequency response can be determined on the basis of the aforementioned description. Possibilities for specifying the description of the frequency response are explained in greater detail below. The control device 6 therefore not only determines the respective control value A2, A3 in the manner by means of which allowances are made for the corresponding inverse frequency response. Rather, the control device 6 explicitly identifies the corresponding inverse frequency response as such. Therefore, characteristic variables that define the inverse frequency response are known to the control device 6. This is explained more specifically below in association with the rolling stand 2. Analogous statements apply in each case to the feeding device 3 and, if appropriate, the measuring device 4 as well.

The rolling stand 2 can be modeled in various ways. In the simplest case, the rolling stand 2 is modeled as a PT1 element. Alternatively, higher-order modeling comes into consideration. The modeling describes the rolling stand 2 as such, if applicable including its control. By contrast, the transporting time, i.e. the time period T' is not part of the modeling.

The frequency response of the rolling stand 2 can be described for example by a transfer function. If—in the generally customary way—the transfer function as such is denoted by G and the Laplace operator is denoted by letter s, the transfer function G(s) can be written as $$G(s) = \frac{b_m \cdot s^m + b_{m-1} \cdot s^{m-1} + \ldots + b_1 \cdot s + b_0}{c_n \cdot s^n + c_{n-1} \cdot s^{n-1} + \ldots + c_1 \cdot s + c_0} \tag{1}$$

In this case, $b_i$ (where i=1, 2 . . . m) and $c_j$ (where j=1, 2 . . . n) are constant coefficients. The degree m of the numerator polynomial is, as a maximum, equal to the degree n of the denominator polynomial. If the rolling stand 2 is modeled as a PT1 element, the transfer function G(s) is obtained for example as $$G(s) = \frac{1}{T2 \cdot s + 1} \tag{2}$$

where T2 is a characteristic time constant of the rolling stand 2.

For the associated inverse transfer function $G^{-1}$ (s), the following applies in the general case $$G^{-1}(s) = \frac{1}{G(s)} = \frac{c_n \cdot s^n + c_{n-1} \cdot s^{n-1} + \ldots + c_1 \cdot s + c_0}{b_m \cdot s^m + b_{m-1} \cdot s^{m-1} + \ldots + b_1 \cdot s + b_0} \tag{3}$$

The inverse transfer response $G^{-1}$ (s) is consequently clearly defined. If the rolling stand 2 is modeled as a PT1 element, the associated inverse transfer function $G^{-1}$ (s) is obtained exactly as $$G^{-1}(s) = \frac{T2 \cdot s + 1}{1} \tag{4}$$

If the inverse transfer function $G^{-1}$ (s) is modeled exactly, the modeled response of the rolling stand 2 however often becomes unstable. In some cases, even the response of the real rolling stand 2 may become unstable. For example, the inverse of a PT1 element gives a PD element. A PD element amplifies high frequencies extremely. Also, the theoretically determinable output signal of a PD element cannot be implemented in reality. The cause of this are setting limitations of the actuators, here of the rolling stand 2. To ensure the stability and feasibility, the denominator polynomial of the inverse transfer function $G^{-1}$ (s) is therefore extended by a component which is proportional to the highest power of s in the numerator of the inverse transfer function $G^{-1}$ (s). This is known in principle to those skilled in the art. Reference can be made in this respect to the textbook "Stabile Neuronale Online Identifikation and Kompensation statischer Nichtlinearitäten" [Stable neural online identification and compensation of static nonlinearities] by Thomas Frenz. The actually used inverse modeling of the frequency response of the rolling stand 2 is consequently described by a modified inverse transfer function $G^{-1}$ (s), which has the form $$G^{-1}(s) = \frac{T2 \cdot s + 1}{TC \cdot s + 1} \tag{5}$$

TC is a small time, that is to say a time that is considerably smaller than the characteristic time constant T2 of the rolling stand 2. The smaller the time TC can be chosen to be, the better the modeling of the inverse frequency response of the rolling stand 2. In practice, the time TC will be chosen to be equal to the cycle time T or approximately equal to the cycle time T.

Analogous statements apply, as already mentioned, to the feeding device 3. If, analogously to the rolling stand 2, the feeding device 3 is modeled by a PT1 element, the resulting inverse transfer function $G^{-1}$ (s) for the feeding device 3 is described by a modified inverse transfer function $G^{-1}$ (s), which has the form $$G^{-1}(s) = \frac{T3 \cdot s + 1}{TC \cdot s + 1} \tag{6}$$

where T3 is a characteristic time constant of the feeding device 3.

Figure 5:
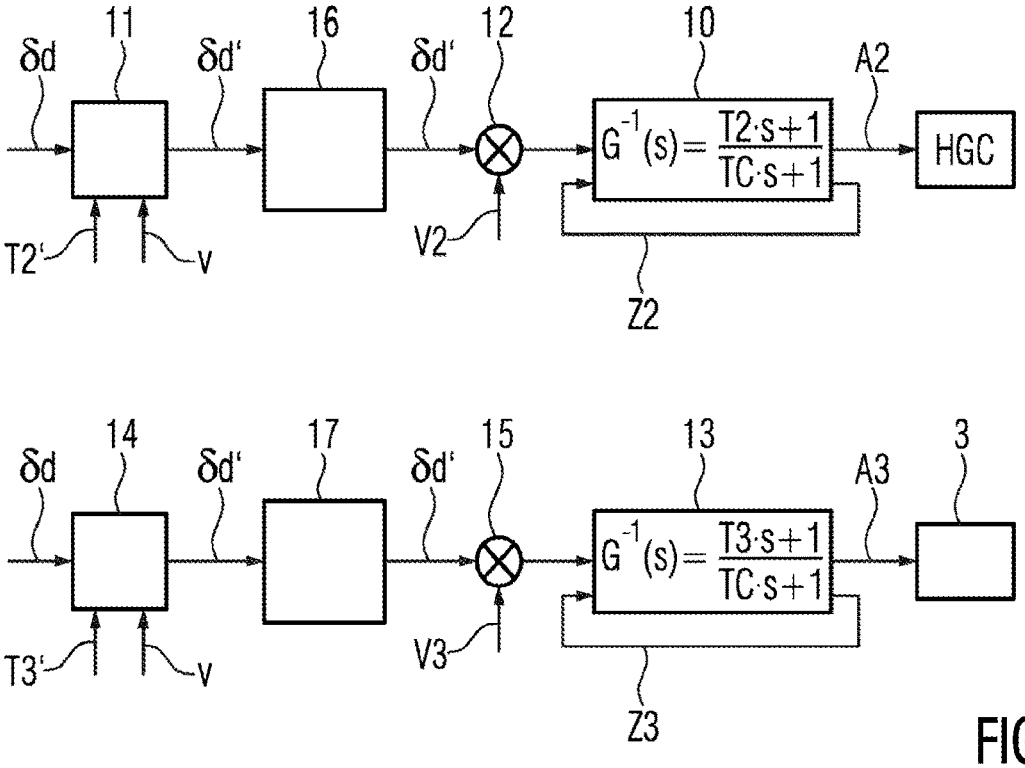
FIG. 5 shows a structural setup of a control device.

On account of the above facts, it is possible, in a way corresponding to the representation in FIG. 5, to specify a corresponding inverse model 10 of the rolling stand 2 for the control device 6. As already explained, the inverse model 10 describes the inverse frequency response of the rolling stand 2, if applicable including the inverse frequency response of the measuring device 4. Allowance can be made according to requirements for constant dead times and the like within the inverse model 10 or outside the inverse model 10 within the scope of the derivative action time T2'. In a way corresponding to the representation in FIG. 5, for example, the inverse model 10 can implement an inverse transfer function $G^{-1}$ (s) of the form $$G^{-1}(s) = \frac{T2 \cdot s + 1}{TC \cdot s + 1} \quad (5)$$

The inverse model 10 is fed—on a clocked basis with the cycle 10 T—in each case the final thickness deviation δd' of a portion 9 of the metal strip 1. The control device 6 determines by means of the inverse model 10, with additional allowance for an internal state Z2 of the inverse model 10, the respective control value A2 for the rolling stand 2 and outputs the control value A2 to the rolling stand 2. Furthermore, the control device 6 correctively adjusts the internal state Z2 by using the respective final thickness deviation δd' and the previous internal state Z2 of the inverse model 10. The allowance for the internal state Z2 and the corrective adjustment of the internal state Z2 are required, since otherwise the inverse model 10 of the rolling stand 2 could not store any knowledge of the previous progression of the final thickness deviation δd' and constantly could not model a frequency response, but merely a purely proportional response.

A transporting model 11 is arranged upstream of the inverse model 10. The transporting model 11 is fed—on a clocked basis with the cycle time T—the respective final thickness deviation δd' and the entry speed v. The transporting model 11 models the path tracking of the respective portion 9 to which the respective final thickness deviation δd' is assigned. Furthermore, a derivative action time T2' is fed to the transporting model 11. The transporting model 11 outputs the respective final thickness deviation δd' with a time delay with respect to the point in time at which the respective final thickness deviation δd' was fed to the transporting model 11. As already mentioned, the time delay is chosen in such a way that the control value A2 output for a specific portion 9 takes effect at the point at time at which the corresponding portion 9 of the metal strip 1 is rolled in the rolling stand 2.

The modeling and implementation of path tracking is generally known to those skilled in the art. Therefore, it need not be explained in greater detail.

In general, furthermore, the respective final thickness deviation δd' is not fed directly to the inverse model 10 of the rolling stand 2 by the transporting model 11, but rather is also multiplied beforehand by a static gain factor V2 in a multiplier 12. By means of the multiplier 12, the respective final thickness deviation δd' is converted into an additional setpoint value for example for the rolling gap of the rolling stand 2 or the main drive of the rolling stand 2. In principle, however, it is also possible to concomitantly integrate the gain factor V2 into the inverse model 10 of the rolling stand 2.

In a totally analogous manner, as already mentioned, it is also possible to effect the modeling of the inverse frequency response of the feeding device 3, optionally including the inverse frequency response of the measuring device 4. In a way corresponding to the representation in FIG. 5, this results in a totally analogous setup comprising an inverse model 13, a transporting model 14 and a multiplier 15. T3' is a derivative action time for the feeding device, and V3 is a gain factor. By means of the multiplier 15, the respective final thickness deviation δd' is converted into an additional setpoint value for the entry speed v of the metal strip 1. If the feeding device 3 does not control the entry speed v, but rather the tension prevailing in the metal strip 1 on the entry side of the rolling stand 2, it may be necessary additionally to make allowance for the moment of inertia of the feeding device 3 as well.

The control value A2 is a vector quantity having in each case a component for the adjustment of the rolling stand 2 and for the main drive of the rolling stand 2, the modelings explained above for the rolling stand 2 have to be implemented separately for each component of the vector quantity. If applicable, therefore, a plurality of inverse submodels are thus present for the rolling stand 2. However, this does not change anything with regard to the principle.

The corresponding control of the rolling stand 2 is effected by means of the control values A2, such that only the least possible fluctuations of the thickness of the metal strip 1 are present on the exit side of the rolling stand 2. The corresponding control of the feeding device 3 is effected by means of the control values A3, such that the entry speed 3 and/or the entry-side tension in the metal strip 1 are/is kept as constant as possible. In particular, the tension influences the pass reduction in the rolling stand 2. In order that changes in the tension prevailing in the metal strip 1 do not have an undesired influence on the pass reduction, the entry speed v has to be adapted synchronously with respect to the changes in the adjustment of the rolling stand 2 and the changes in the circumferential speed of the working rollers of the rolling stand 2.

As already mentioned, the final thickness deviations δd are determined by means of a zero-phase filtering of the provisional thickness deviations δd. A respective zero-phase filter 16, 17 can therefore be arranged upstream or downstream of the transporting models 11, 14. It is also possible to integrate the zero-phase filtering into the respective transporting model 11, 14.

The transporting models 11, 14 are embodied such that they are substantially of identical type. The structure of the control device 6 in FIG. 5 can therefore be modified according to the structure in FIG. 6. As a result, one of the transporting models 11, 14 can be omitted in the configuration according to FIG. 6. A delay element 18 is present instead, by means of which the difference between the derivative action times T2' and T3' is compensated for. The derivative action time T3' will usually be greater than the derivative action time T2'. In this case, illustrated in FIG. 6, the transporting model 14 is omitted and the delay element 18 is furthermore arranged in the path for the control value A2.

The structures of the control device 6 that have been explained above in conjunction with FIGS. 5 and 6 are embodied as software blocks in the control device 6. They are thus formed on the basis of the programming with the control program 7 and the execution of the machine code 8.

Figure 7:
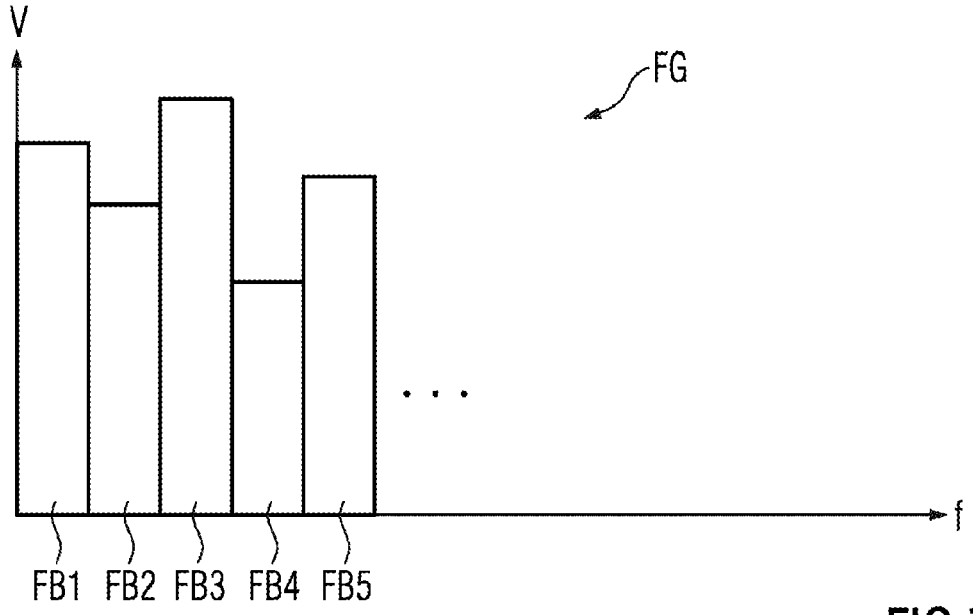
FIG. 7 shows a frequency-response characteristic.

An alternative configuration of the present invention consists in specifying the description of the inverse frequency response of the rolling stand 2—optionally as a combined description also of the inverse frequency-response characteristic of the measuring device 4—as frequency-response characteristic FG. In a way corresponding to the representation in FIG. 7, for various frequency ranges FBk (where k=1, 2 . . . ), frequency-response characteristic FG indicates the respective complex gain V with which a time-variable thickness deviation having a frequency in the respective frequency range FB has to be amplified in order to be completely compensated for.

The frequency-response characteristic FG is based on the following consideration: if a metal strip 1 of constant thickness is fed to the rolling stand 2 and if, furthermore, the control value A2 fed to the rolling stand 2 is varied with a specific amplitude and a specific frequency, then it is found that for the same amplitude of the control value A2 (=input variable), the extent to which a change in thickness is imparted to the metal strip 1 by the rolling stand 2 on the exit side (=output variable) is dependent on the frequency. Specifically, both the amplitude and the phase angle of the exit-side change in thickness change. In particular, in practice, it is found that as the frequency rises, the amplitude of the exit-side thickness deviation decreases and the phase delay increases. Depending on the frequency of the entry-side final thickness deviation δd', the correction variable "change in the position of the rolling stand 2" and/or "change in the torque of the working rollers" or "change in the rotational speed of the working rollers" therefore has to be adapted dynamically in terms of amplitude and phase angle in order to generate an optimum correction signal. In order to compensate for a final thickness deviation δd' that occurs with a higher frequency on the entry side of the rolling stand 2, the rolling stand 2 thus has to be controlled to a greater extent.

The amplitude and phase angle of the reaction of the rolling stand 2 to the respective control value A2 can be combined into a complex factor for the respective frequency. For the respective frequency, the inverse of the respective complex factor corresponds to a—complex—gain factor V with which a thickness deviation of the respective frequency has to be scaled in order that it is completely compensated for on the output side of the rolling stand 2. The totality of these gain factors V, i.e. the gain factors V for different frequencies or frequency ranges FB, form the frequency-response characteristic FG that is specified for the control device 6.

Figure 8:
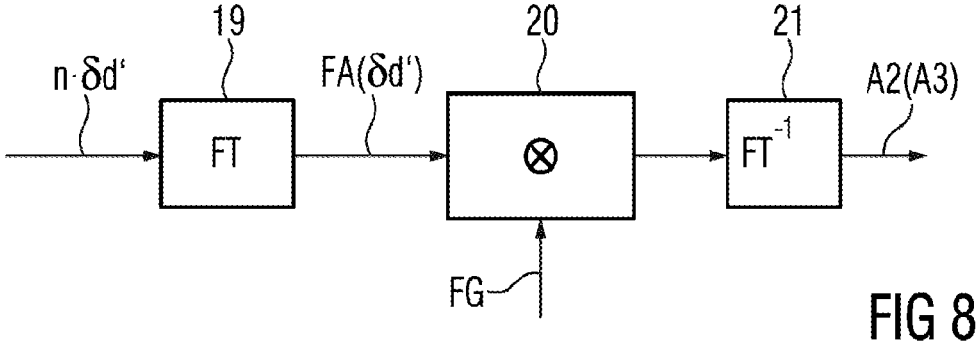
FIG. 8 shows a further structural setup of a control device.

If the description of the frequency response is specified for the control device 6 as such a frequency-response characteristic FG, the procedure corresponding to the representation in FIG. 8 can be adopted for the determination of a respective control value A2. The procedure in FIG. 8 may need to be carried out separately for each component of the respective control value A2.

According to FIG. 8, for the respective portion 9 and a plurality of further portions 9, the respective final thickness deviation δd' is specified for the control device 6. The final thickness deviations δd' form a temporal profile. The control device 6 transforms the temporal profile into the frequency domain in a transformation block 19. By way of example, the control device 6 can carry out a Fourier transformation (FT), in particular an STFT (=short time Fourier transformation), in the transformation block 19. The Fourier transformation can be continuous or discrete, as required. It can likewise be analog or digital, as required. Furthermore, other transformations, for example a discrete cosign transformation, are also conceivable as an alternative to a Fourier transformation.

Irrespective of the concrete procedure, the control device 6 determines the frequency components FA of the aforementioned profile by means of the transformation block 19. In a downstream determination block 20—separately for the individual frequency range FB—the respective frequency component FA is multiplied by the gain factor V for the respective frequency range FB. The transformed profile is thus multiplied by the frequency-response characteristic FG. On account of the multiplication in the complex frequency domain, as a result amplitudes are scaled and phases are also shifted. By way of this multiplication, a corrected spectrum of the final thickness deviations δd' is generated in the frequency domain, said spectrum optimally compensating for the frequency-dependent transfer response of the rolling stand 2.

In a further transformation block 21, the control device 6 transforms the output signal of the determination block 20—i.e. the frequency-wise scaled frequency profile—back into the time domain. The transformation in the transformation block 21 is the inverse of the transformation in the transformation block 19. From the output signals of the transformation block 21, the control device 6 finally picks out the one which was determined for the respective portion 9.

The number of final thickness deviations δd' used in the context of the procedure according to FIG. 8 can be determined as required. It is particularly appropriate to choose the number in such a way that it is equal to a power of two. For then the Fourier transformation can be implemented as a fast Fourier transformation.

Figure 9:
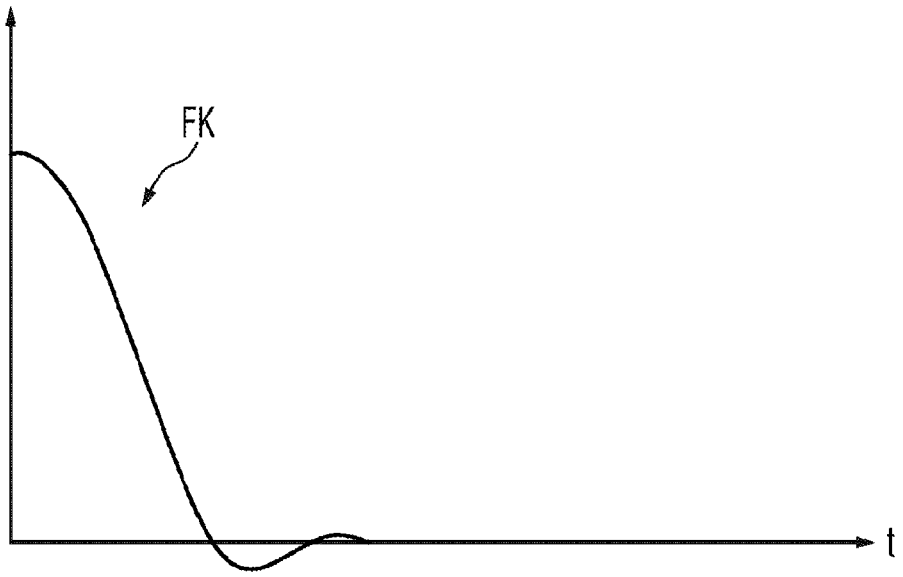
FIG. 9 shows a convolution kernel.

It is generally known to those skilled in the art that a multiplication in the frequency domain corresponds to a convolution in the time domain. As an alternative to specifying a frequency-response characteristic FG, it is therefore possible to specify a convolution kernel FK for the control device 6 in a way corresponding to the representation in FIG. 9. The convolution kernel FK can be determined for example by way of an isolated transformation of the frequency-response characteristic FG from FIGS. 7 and 8 into the time domain.

If the description of the frequency response is specified as such a convolution kernel FK for the control device 6, the procedure corresponding to the representation in FIG. 10 can be adopted for the determination of a respective control value A2 as follows:

For the respective portion 9 and a plurality of further portions 9—as in the case of FIG. 8 as well—the respective final thickness deviation δd' is specified for the control device 8. The final thickness deviations δd' form—as in the case of FIG. 8 as well—a temporal profile. In a determination block 22, the control device 6 carries out a convolution of this profile with the convolution kernel FK. From the output signals of the determination block 22, the control device 6 picks out as control value A2 the one which was determined for the respective portion 9.

Figure 10:
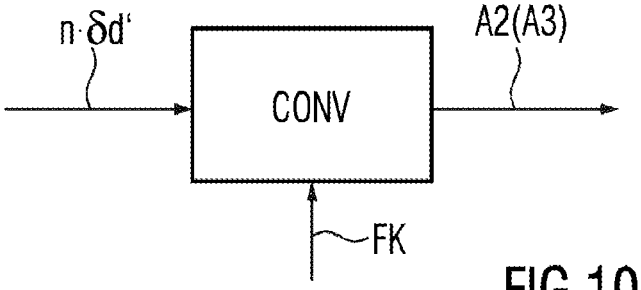
FIG. 10 shows a further structural setup of a control device.

In the context of the procedures according to FIGS. 8 and 10, too, in each case only a single final thickness deviation δd' is explicitly newly fed to the control device 6. The other final thickness deviations δd' required have already been fed to the control device 6 in the context of the implementation of previous cycles. Therefore, they need only be buffer-stored there and retrieved again and used.

The procedures in FIGS. 8 and 10 have been explained above in association with the determination of the control value A2 for the rolling stand 2. Totally analogous procedures are possible for the determination of the control value A3 for the feeding device 3. In both cases, allowance can concomitantly also be made for the frequency response of the measuring device 4, as necessary, in addition to the frequency response of the respective device 2, 3.

Figure 6:
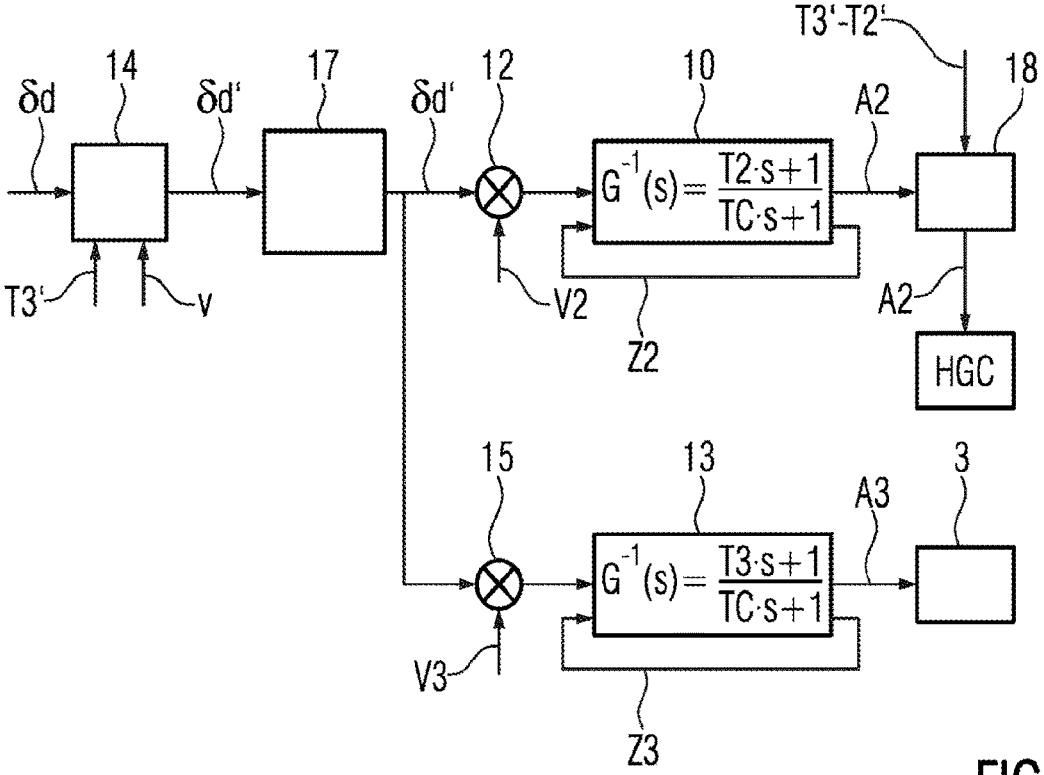
FIG. 6 shows a further structural setup of a control device.

The structures of the control device 6 that have been explained above in conjunction with FIGS. 8 and 10—just like the structures of the control device 6 according to FIGS. 5 and 6—are embodied as software blocks in the control device 6. They are thus formed on the basis of the programming with the control program 7 and the execution of the machine code 8.

In each of the configurations of the present invention, it is possible for the further portions 9 whose final thickness deviation δd' is taken into account in the context of determining the respective control value A2, A3 to be exclusively portions 9 which precede the respective portion 9 of the metal strip 1. Likewise, in the configurations in FIGS. 8 and 10, it is possible for the further portions 9 to be exclusively portions 9 which succeed the respective portion 9 of the metal strip 1. In general, however, in the case of the configurations in FIGS. 8 and 10, a better result is obtained if a mixed procedure is implemented, that is to say if a proportion of the further portions 9 precede the respective portion 9 of the metal strip 1 and a further proportion of the further portions 9 succeed the respective portion 9 of the metal strip 1. By way of example, it is always possible to use those portions 9 which—relative to that portion 9 whose thickness d is detected in the respective cycle—are situated in the region designated by 23 in FIG. 3.

FIG. 3 at the same time also shows a further advantageous configuration. This is because if the control value A2, A3 are determined in each case for the portion 9*c*, in a way corresponding to the representation in FIG. 3 the number of portions 9 of the metal strip 1 which precede the respective portion 9 of the metal strip 1 and whose final thickness deviations δd' are used by the control device 6 for determining the respective control value A2 is substantially equal to the number of portions 9 of the metal strip 1 which succeed the respective portion 9 of the metal strip 1 and whose final thickness deviations δd' are used by the control device 6 for determining the respective control value A2, A3. A slight deviation (for example up to two portions 9 more or fewer) is generally unproblematic, however. Furthermore, it is often appropriate to use a total of $2^n$ portions. In this case, the number of portions 9 preceding the respective portion 9 of the metal strip 1 is preferably exactly 1 greater or 1 less than the number of portions 9 of the metal strip 1 succeeding the respective portion 9 of the metal strip 1.

The present invention has many advantages. In particular, an almost complete correction of entry-side thickness deviations δd is obtained in an easy way. This applies especially if both the control value A2 and the control value A3 are determined in the manner according to the invention. It is furthermore straightforwardly possible to retrofit existing rolling mills in a manner according to the invention. This is because the hardware as such, i.e. the rolling stand 2, the feeding device 3, the measuring devices 4, 5 and the control device 6, do not have to be modified. All that is necessary is for the control program 7 for the control device 6 to be modified.

Although the invention has been more specifically illustrated and described in detail by means of the preferred exemplary embodiment, nevertheless the invention is not restricted by the examples disclosed and other variants can be derived therefrom by a person skilled in the art without departing from the scope of protection of the invention.

LIST OF REFERENCE SIGNS

1 Metal strip
2 rolling stand
3 Feeding device
4, 5 Measuring devices
6 Control device
7 Control program
8 Machine code
9 Portions
10, 13 inverse models
11, 14 Transporting models
12, 15 Multipliers
16, 17 Zero-phase filters
18 Delay element
19, 21 Transformation blocks
20, 22 Determination blocks
23 Region
a Distance
A2, A3 Control values
d Thickness value
d* Setpoint thickness
FA Frequency components
FB Frequency ranges
FG Frequency-response characteristic
FK Convolution kernel
G Transfer function
s Laplace operator
S1 to S5 Steps
T Cycle time
T2, T3 Characteristic time constants
T2', T3' Derivative action times
v Entry speed
V, V2, Gain factors
V3
Z2, Z3
Internal states
δd, δd' Thickness deviations

The invention claimed is:

1. An operating method for a rolling mill, wherein a metal strip is fed to a rolling stand of the rolling mill at an entry speed (v) by a feeding device arranged upstream of the rolling stand, wherein the metal strip is rolled in the rolling stand, wherein a thickness value (d) for the thickness of the metal strip is detected in each case for successive portions of the metal strip by means of a measuring device arranged between the feeding device and the rolling stand, wherein the detected thickness values (d) are fed to a control device of the rolling mill, wherein the control device determines a respective provisional thickness deviation (δd) on the basis of the deviation of the respective thickness value (d) from a setpoint thickness (d*) for the respective portion of the metal strip, wherein the control device determines final thickness deviations (δd') on the basis of the provisional thickness deviations (δd), wherein the control device determines a control value (A2, A3) for the rolling stand and/or the feeding device in each case for the portions of the metal strip and outputs the respective control value (A2, A3) to the rolling stand and/or the feeding device at the correct time, wherein the control device is provided with an inverse model that describes an inverse frequency response of the rolling stand and/or the feeding device and/or the measuring device. and wherein the control device determines the respective control value (A2, A3) on the basis of the final thickness deviation (δd') of the respective portion of the metal strip and also the final thickness deviations (δd') of a plurality of portions of the metal strip preceding and/or succeeding the respective portion of the metal strip, with the inverse model of the rolling stand and/or the feeding device and/or the measuring device.

2. The operating method as claimed in claim 1, wherein the description of the inverse frequency response of the rolling stand and/or the feeding device and/or the measuring device is specified for the control device by an inverse model, in that the final thickness deviation (δd') of a portion of the metal strip is in each case fed to the inverse model, and in that the control device using the respective final thickness deviation (δd') by means of the inverse model correctively adjusts an internal state (Z2, Z3) of the inverse model and determines the respective control value (A2, A3).

3. The operating method as claimed in claim 1, wherein the control device adopts the provisional thickness deviations (δd) 1:1 as final thickness deviations (δd'), or in that the control device determines the final thickness deviations (δd') from the provisional thickness deviations (δd) by means of a zero-phase filtering.

4. The operating method as claimed in claim 3, wherein a low-pass filtering of the provisional thickness deviations (δd) is carried out by means of the zero-phase filtering.

5. An operating method for a rolling mill, wherein a metal strip is fed to a rolling stand of the rolling mill at an entry speed (v) by a feeding device arranged upstream of the rolling stand, wherein the metal strip is rolled in the rolling stand, wherein a thickness value (d) for the thickness of the metal strip is detected in each case for successive portions of the metal strip by means of a measuring device arranged between the feeding device and the rolling stand, wherein the detected thickness values (d) are fed to a control device of the rolling mill, wherein the control device determines a respective provisional thickness deviation (δd) on the basis of the deviation of the respective thickness value (d) from a setpoint thickness (d*) for the respective portion of the metal strip, wherein the control device determines final thickness deviations (8d') on the basis of the provisional thickness deviations (δd);

wherein the control device determines a control value (A2, A3) for the rolling stand and/or the feeding device in each case for the portions of the metal strip and outputs the respective control value (A2, A3) to the rolling stand and/or the feeding device at the correct time, wherein the control device determines the respective control value (A2, A3) on the basis of the final thickness deviation (δd') of the respective portion of the metal strip and also the final thickness deviations (δd') of a plurality of portions of the metal strip preceding and/or succeeding the respective portion of the metal strip, with allowance for a description of the inverse frequency response of the rolling stand and/or the feeding device and/or the measuring device, and wherein the description of the inverse frequency response of the rolling stand and/or the feeding device and/or the measuring device is specified for the control device as a frequency-response characteristic (FG), and in that the control device determines the respective control value (A2, A3) by a transformation of the profile of the final thickness deviations (δd') into the frequency domain, a subsequent multiplication of the transformed profile of the final thickness deviation (δd') by the frequency-response characteristic (FG) and a subsequent inverse transformation into the time domain.

6. The operating method as claimed in claim 5, wherein for determining the respective control value (A2, A3) the control device uses both final thickness deviations (δd') of portions of the metal strip preceding the respective portion of the metal strip and final thickness deviations (δd') of portions of the metal strip succeeding the respective portion of the metal strip.

7. The operating method as claimed in claim 6, wherein the number of portions of the metal strip which precede the respective portion of the metal strip and whose final thickness deviations (δd') are used by the control device for determining the respective control value (A2, A3) is substantially equal to the number of portions of the metal strip which succeed the respective portion of the metal strip and whose final thickness deviations (δd') are used by the control device for determining the respective control value (A2, A3).

8. An operating method for a rolling mill, wherein a metal strip is fed to a rolling stand of the rolling mill at an entry speed (v) by a feeding device arranged upstream of the rolling stand, wherein the metal strip is rolled in the rolling stand, wherein a thickness value (d) for the thickness of the metal strip is detected in each case for successive portions of the metal strip by means of a measuring device arranged between the feeding device and the rolling stand, wherein the detected thickness values (d) are fed to a control device of the rolling mill, wherein the control device determines a respective provisional thickness deviation (δd) on the basis of the deviation of the respective thickness value (d) from a setpoint thickness (d* for the respective portion of the metal strip, wherein the control device determines final thickness deviations (δd') on the basis of the provisional thickness deviations (δd), wherein the control device determines a control value (A2, A3) for the rolling stand and/or the feeding device in each case for the portions of the metal strip and outputs the respective control value (A2, A3) to the rolling stand and/or the feeding device at the correct time, wherein the control device determines the respective control value (A2, A3) on the basis of the final thickness deviation (δd') of the respective portion of the metal strip and also the final thickness deviations (δd') of a plurality of portions of the metal strip preceding and/or succeeding the respective portion of the metal strip, with allowance for a description of the inverse frequency response of the rolling stand and/or the feeding device and/or the measuring device, and wherein the description of the inverse frequency response of the rolling stand and/or the feeding device and/or the measuring device is specified for the control device as a convolutional kernel (FK), and in that the control device determines the respective control value (A2, A3) by a convolution of the profile of the final thickness deviations (δd') with the convolutional kernel (FK).

* * * * *